United States Patent [19]

Bekker et al.

[11] 4,235,152

[45] Nov. 25, 1980

[54] STABILIZER FOR GUNS

[76] Inventors: Marthinus J. Bekker, 3 Pomeroy Rd., Hatfield, Salisbury; Douglas J. M. Hall, 23 Taunton Rd., Mandara, Salisbury, both of Southern Rhodesia

[21] Appl. No.: 868,631

[22] Filed: Jan. 11, 1978

[51] Int. Cl.[3] ..... F41C 21/18

[52] U.S. Cl. ..... 89/14 C

[58] Field of Search ..... 89/14 C, 14 B; 42/79

[56] References Cited

U.S. PATENT DOCUMENTS 2,065,273 12/1936 Galliot ..... 89/14 C

FOREIGN PATENT DOCUMENTS 606478 8/1978 United Kingdom ..... 89/14 C

*Primary Examiner*—Stephen C. Bentley

*Attorney, Agent, or Firm*—Neal A. Waldrop; Jay C. Taylor

[57] ABSTRACT

A stabilizer for a gun comprising a tubular element is adapted to fit on the muzzle end of a gun barrel or flash hider and is releasably secured in position by a stop carried by a lever pivoted on the element. The lever is yieldably urged by resilient means to move the stop through an opening in the element and into a recess in the barrel or flash hider. A plurality of stabilizing vents are provided in the element for discharging combustion gases from the gun and a plurality of exterior gas directing projections on the element are associated with certain of the vents for directing the gases from all of the associated vents essentially in the same direction to one side of the element.

5 Claims, 14 Drawing Figures

FIG. 6
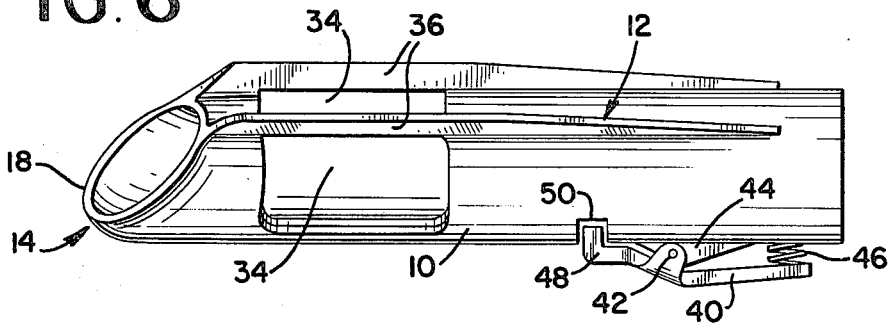
FIG. 7
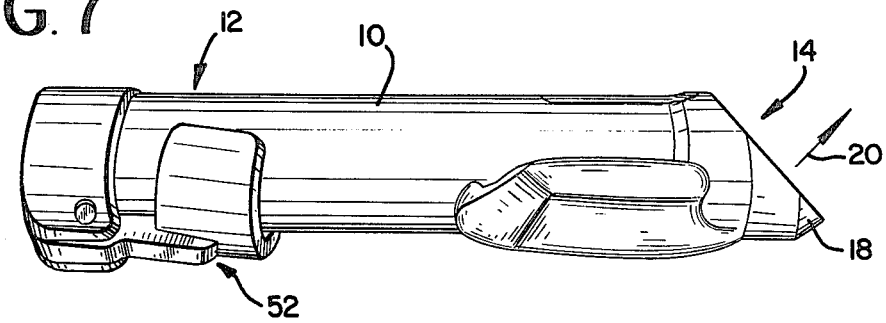
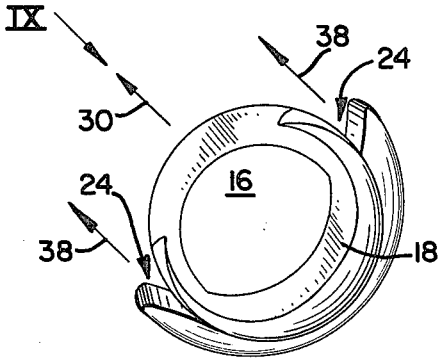
FIG. 8
FIG. 9
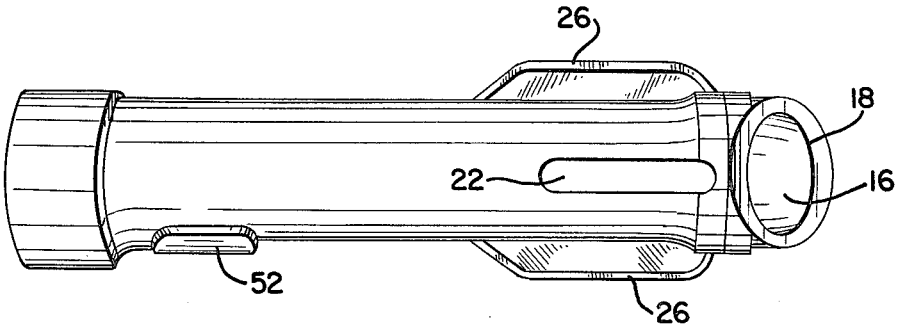

STABILIZER FOR GUNS

THIS INVENTION relates to weapons and, in particular, to stablisers for guns.

According to the invention, there is provided a stabiliser for a gun, the stabiliser comprising a tubular element dimensioned to fit on the muzzle end of a gun barrel or flash hider (also known as 'flash suppressor', 'flash eliminator', 'muzzle break' and by other terms) and containing at least one stabilising vent, each vent being disposed or adapted to direct combustion gases from a gun barrel or flash hider primarily to one side of the element; and further comprising locating means for securing the element on a gun barrel or flash hider.

The element may have a slotted portion for fitting around the muzzle end of a gun barrel or flash hider and the locating means for securing the element on the gun barrel or flash hider may be a clip for tightening the slotted portion so that it clamps the gun barrel or flash hider. Alternatively, the locating means for securing the element may be a stop passing through the element for engaging a notch in the periphery of the gun barrel or flash hider. The stop can be resiliently biassed to a condition in which it passes through the element and is retractable against the resilent biassing.

The invention also provides a stabiliser for a gun, the stabiliser comprising a tubular element dimensioned to fit on the muzzle end of a gun barrel or flash hider and containing at least one stabilising vent, each vent being disposed or adapted to direct combustion gases from a gun barrel or flash hider primarily to one side of the element; and further comprising locating means for engaging in a flash hider vent or a suitable location on a gun barrel for securing the element on a gun barrel or flash hider.

The locating means for securing the element may be a stop for passing through the element and engaging in a flash hider vent or the gun barrel. The stop can be mounted on a lever which can move it to a condition in which it passes through the element and may be retractable from the vent by the lever. The locating means may have a clip for securing the lever in position with the stop projecting into the vent by resiliently but releasably engage the barrel or flash hider.

A stabiliser according to the invention may have an opening in the element through which a projectile can pass and a slightly curved portion adjacent to the opening to direct combustion gases to the same side of the element as does the vent.

In a preferred form, one or more vents are provided with deflectors, thereby adapting them to direct combustion gases primarily to said one side of the element, and other vent or vents are provided without deflectors and are disposed to direct combustion gases primarily to said one side of the element.

Embodiments of the invention will now be described by way of example, with reference to the accompanying drawings, in which:

FIG. 6 shows the stabiliser of FIGS. 4 and 5 as seen in the direction of arrow VI in FIG. 5;

FIG. 7 is a side elevation of a third stabiliser;

FIG. 8 is an end view of the stabiliser of FIG. 7;

FIG. 9 shows the stabiliser of FIG. 7 as seen in the direction of arrow IX of FIG. 8;

Figure 1:
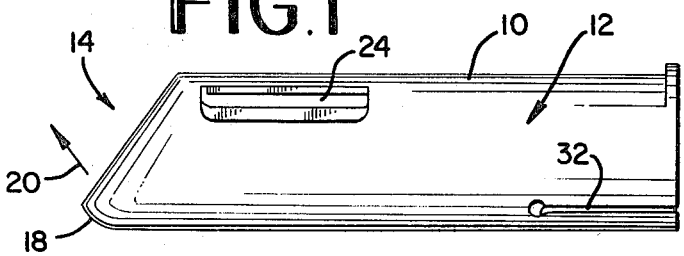
FIG. 1 is a side elevation of a stabiliser.
Figure 2:
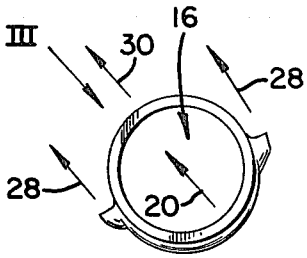
FIG. 2 is an end elevation showing the stabiliser of FIG. 1.
Figure 3:
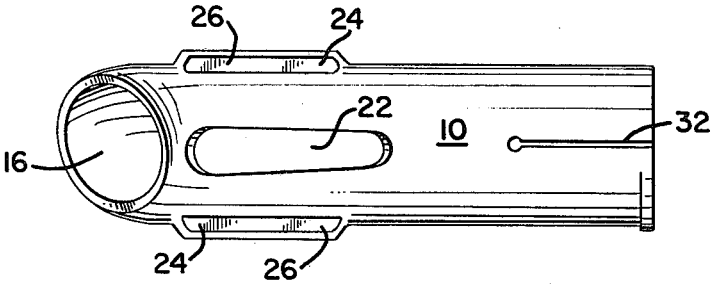
FIG. 3 is a view of the stabiliser seen in the direction of arrow III in FIG. 2.

Referring firstly to FIGS. 1 to 3, a stabiliser for a gun comprises an elongate tubular element 10 having a body portion 12 which is dimensioned to fit snugly around the muzzle end of a gun barrel or flash hider. The element 10 also has an outlet end 14 with an opening 16 through which a projectile leaving the barrel can pass.

The outlet 16 is formed slightly to one side of the longitudinal axis of the element 10, and the outlet end 14 has a part-spherical deflector 18 for deflecting combustion gases from the gun barrel generally in the direction of arrow 20 in FIGS. 1 and 2.

Although the opening 16 appears to be substantially circular when viewed axially of the element 10, it is, in fact, elliptical because it is inclined to the axis of the element. A vent 22 is formed in the wall of the element and is slightly to one side of the major axis of the elliptical opening 16. Two further vents 24 are formed in the element 10 and, like the vent 22, extend axially of the element. Deflectors 26 are formed adjacent to the vents 24 and serve to deflect combustion gases from the vents 24 generally in the direction of arrows 28. Thus, the combustion gases passing through the vents are directed primarily to one side of the element 10.

The portion 12 of the element is provided with slots 32, and a securing device may be located around this end portion of the element and tightened to clamp the end portion 12 onto the muzzle end of a gun barrel or flash hider.

Figure 4:
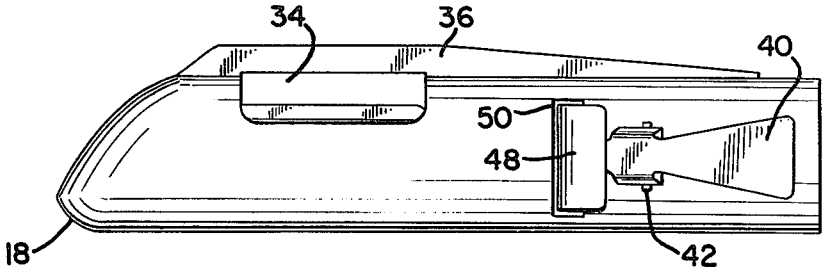
FIG. 4 is a side elevation of an alternative stabiliser.
Figure 5:
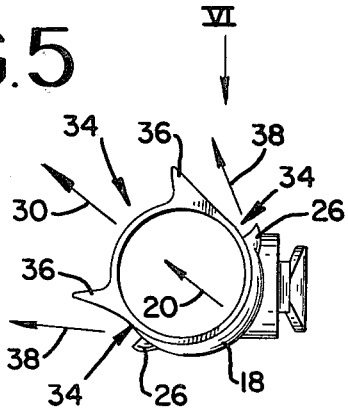
FIG. 5 is an end view of the stabiliser of FIG. 4.
Figure 10:
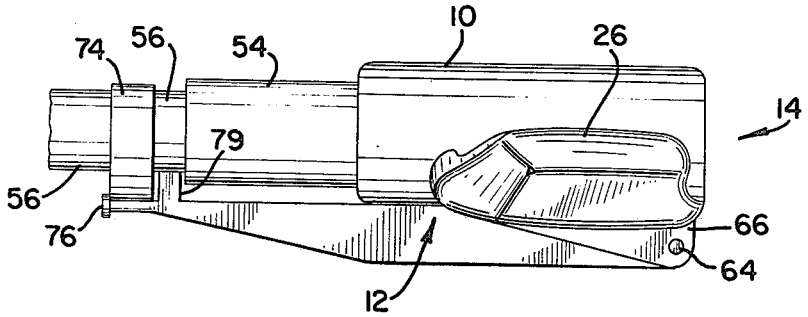
FIG. 10 is a side elevation of a stabiliser on a flash hider which is on an end part of a gun barrel.
Figure 11:
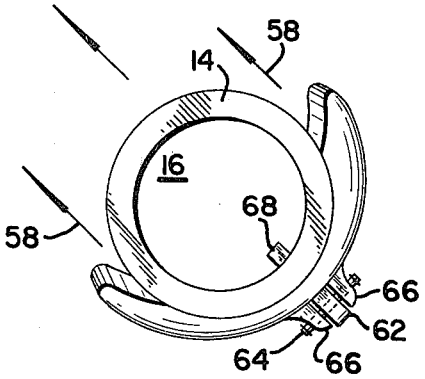
FIG. 11 is an end elevation showing the stabiliser of FIG. 10.
Figure 13:
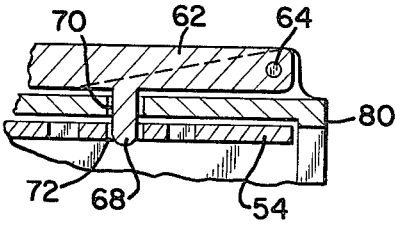
FIG. 13 is a cross-section through part of the stabiliser and part of the flash hider.

The stabiliser shown in FIGS. 4 to 6, also has an element 10 having a body portion 12 with means for securing the element to a gun barrel or flash hider. The element also has an outlet end 14 which is substantially identical to that of the element of FIGS. 1 to 3. However, the stabiliser of FIGS. 4 to 6 has three substantially rectangular vents 34 which are separated from one another by elongate reinforcing fins 36 extending axially along the periphery of the element. The vent 34 between the fins 36 acts in much the same way as the vent 22 of FIG. 3, and thus directs combustion gases generally in the direction of arrow 30. The other two vents are each formed between a fin 36 and a deflector 26, similar to the deflectors of FIGS. 1 to 3, and the deflectors and fins serve to deflect combustion gases substantially in the direction of arrows 38 in FIG. 5. Thus, the vents again serve to direct combustion gases primarily to one side of the stabiliser.

In the stabiliser of FIGS. 4 to 6, the means for securing the element onto a gun barrel or flash hider comprises a lever 40 which is pivitally mounted at 42 on a mounting 44, and which is pivotally biassed by a spring 46 so that a stop 48 on the lever passes into the interior of the element through a hole 90 in the peripheral wall of the element. The stop 48 can engage in a suitable notch in the barrel or flash hider, and the spring 46 can serve to hold it in the notch. The stop 48 can be retracted against the biassing action of the spring 46 by applying pressure to the lever 40 in the region of the spring 46, thus enabling the stabiliser to be removed from the barrel or flash hider.

The stabiliser of FIGS. 7 to 9 also has a tubular element 10 with a body portion 12 dimensioned to fit snugly onto a gun barrel or flash hider and an outlet end 14 with an opening 16 through which a projectile can pass. The element 10 in these Figures has vents 22 and 24 and deflectors 26 similar to these in FIG. 1. A curved portion 18 provides a further deflector for combustion gases. This stailiser has an attachment device 52, which is not shown in detail as it is similar to that for conventionally securing a bayonet onto a flash hider of a rifle barrel and including a catch for engaging a notch in the flash hider or barrel.

Referring to FIGS. 10 to 14, a further stabiliser for a gun comprises an elongate tubular element 10 having a main body portion 12 which is dimensioned to fit snugly around a flash hider 54 or the muzzle end of a gun barrel 56. The element 10 also has an outlet end 14 with an opening 16 through which a projectile leaving the barrel can pass.

A central vent 22 is formed in the main body portion of the element. Two side vents 24 of similar shape to the vent 22 are formed in the element on opposite sides to each other and parallel to the vent 22. The vents 22 and 24 extend axially of the element. Deflectors 26 are formed adjacent to the vents 24 and serve to deflect combustion gases from the vents 24 generally in the direction of arrows 58. Thus, the combustion gases passing through the vents are directed primarily to one side of the element 10.

For securing the element onto a gun barrel or flash hider, a lever 62 is pivitally mounted on pin 64 between mounting ribs 66 on the element. A stop 68 on the lever passes into the interior of the element through a hole 70 in the peripheral wall of the element. The stop 68 can engage in a suitable flash hider port 72 in the flash hider of the barrel. A spring clip 74 mounted on the lever 62 can serve to hold it in position shown in the Figures. A retaining catch 79 is incorporated into the lever 62 to assist in locating the stabiliser and to prevent forward movement by the stabiliser. An internal wall 80 is incorporated within the element 10 to prevent backward movement by the stabiliser.

As shown in FIGS. 10 to 14, spring clip 74 is pivotally mounted on a pin 76 at the free end of the lever 62 and is partly circular. The spring clip 74 can be pivotally mounted before the free end of the lever 62 so that the spring clip 74 partly encircles the flash hider, or it can partly encircle the barrel adjacent to the flash hider 54 and remains in position by virtue of its own resilience. As long as the clip 74 remains in the position shown, the lever 62 keeps the stop 68 in the appropriate part and the element 10 is held in place. The stop can be retracted from the vent 72 by releasing the spring clip 74 by merely applying pressure to the bent region 78 of the spring clip and springing the clip off the barrel or flash hider, thus enabling the stabiliser to be removed rapidly from the gun. Removal of the element is necessary, for example, when the rifle is to be used to launch a rifle grenade accurately. The vents 22 and 24 referred to in FIGS. 1 to 14 can be either elongated slots or holes or a combination of slots and holes to suit any particular gas ports on any gun barrel or flash hider.

The operation of the stabilisers shown is similar, and this operation will now be described by way of example with reference to the stabiliser of FIGS. 10 to 14. However, it will be appreciated that similar comments apply to the operation of the stabilisers of FIGS. 1 to 9.

The stabiliser shown in FIGS. 10 to 14 is designed primarily for use with the 'NATO FN FAL' infantry rifle. When holding such a rifle in its firing position, the marksman can see certain flash hider gas exhaust ports. There are twelve such ports in all, and these can be numbered in four series of three ports each. Proceeding in a clockwise direction as seen by the marksman, series 'A' would be in the 'two o'clock' position; series 'B' would be in the 'four o'clock' position; series 'C' would be in the 'eight o'clock' position; and series 'D' would be in the 'ten o'clock' position. For a right-handed marksman the stabiliser is mounted on the flash hider 54 so that the ports of series 'A' are aligned with the vent 22 enabling combustion gases expelled through these ports to escape generally in the direction of arrows 58. The vents 24 and deflectors 26 are aligned with the three ports of series 'B' and with the three ports of series 'D'. The gases, on six ports, strike deflectors which re-direct the gases from their natural path so that they are exhausted in the general direction of arrows 58. The ports of series 'C' are closed off so that no gases are exhausted directly.

Figure 12:
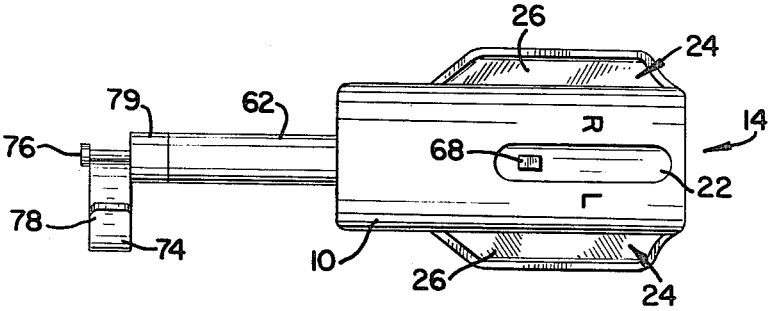
FIG. 12 is a view of the stabiliser seen in the direction of arrow XII in FIG. 11.
Figure 14:
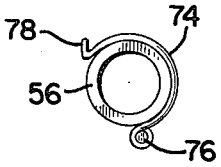
FIG. 14 is an end view showing a clip of the stabiliser of FIG. 10.

Because the stop engages in a flash hider vent, it is possible for right or left handed people to use the same stabiliser. The letter 'R' on the stabiliser of FIG. 12 is uppermost on the barrel when right handed people are to use the stabiliser (in the manner just described) and the letter 'L' must be uppermost for left handed people. In each case, a port in a different series of flash hider ports is engaged by the stop 68. For a left handed marksman the stabiliser is mounted on the flash hider 54 so that the ports of series 'D' are aligned with the vent 22 enabling combustion gases expelled through these ports to escape generally in the direction of arrows 58. The vents 24 and deflectors 26 are aligned with the three ports or series 'A' and with the three ports of series 'C'.

Without the stabiliser, the NATO FN FAL infantry rifle used by a right handed marksman, when fired on automatic, has a definite tendancy to rise upwards and to the right at an angle of approximately 45 degrees. Even if the marksman holds the weapon firmly, the result is highly inaccurate rifle fire with most of the bullets striking above and to the right of the target. This means that automatic fire is wasteful and ineffective due to the high rate at which bullets are expended inaccurately. For 'double tap' shooting, i.e. when the rifle is fired with single rounds in bursts of two shots fired in rapid succession by double-tapping the trigger, the marksman has to re-aim for each 'double tap' because of the tendancy of the weapon to rise. Also, when firing single rounds without the stabiliser, the weapon tends to rise upwards and to the right, although this is less noticeable than with fully automatic firing, there is a need to re-aim for each shot, otherwise inaccurate fire will result. Similar problems arise for left handed marksmen but the tendency is for the rifle to rise to the left. Similar problems are encountered with most automatic weapons.

Once the stabiliser has been properly attached to the rifle, the tendency of the rifle muzzle to rise is largely removed. This means that the rifle is more accurate and can be fired more efficiently.

When the stabiliser is held firmly in place on the rifle there is a tendency for the stabiliser to pull the weapon forward away from the marksman and thereby to reduce shoulder recoil. Due to a reduction of the recoil, fire with the stabiliser can still be more accurate than without it.

The stabiliser can be quickly and easily removed from or replaced on a rifle barrel or flash hider without the use of any tools and thus the rifle can still be used with rifle grenades, blank firing attachments, bayonets, and other accessories. The weapon requires absolutely no alteration in order to enable the stabiliser to be used.

The deflectors 26 can be positioned so as to re-direct gases so as to neutralise any bias, lift or movement experienced with guns which are mounted, whether permanently or temporarily to bipods, tripods, wheels or any fixed or temprary pedastals.

The stabilisers illustrated in FIGS. 1 to 14 can be manufactured from a variety of steels or ferrous or non-ferrous materials at relatively low cost and the stabiliser can be of fairly light-weight construction so that it will not significantly affect the overall weight of the weapon to which it is attached.

Although the stabiliser has been described with reference to use on an FN FAL infantry rifle, the stabiliser can be used on other types of guns. However, it is possible that the specific design of the stabiliser will have to be modified for each type of gun to take into account specific features of that type of gun, such as the barrel diameter and flash hider design.

The portion 18 of each of the stabilisers described in FIGS. 1 to 9 can be eliminated. However, in order for these stabilisers to work efficiently without the portion 18 it may sometimes be necessary to provide gas transfer channels in the element 10 to guide combustion gases from the ports of series 'C' to the ports of series 'B' and 'D' in the case of right handed marksmen and to guide combustion gases from the ports of series 'B' to the ports of series 'A' and 'C' in the case of left handed marksmen.

We claim:

1. A stabilizer for a gun having flash hider means comprising a plurality of ports in the gun barrel adjacent its muzzle end for discharging combustion gases transversely of the longitudinal axis of the barrel, the stabilizer comprising a tubular element dimensioned to fit at a predetermined rotational position on the flash hider means and containing a stabilizing vent disposed to direct said combustion gases primarily to one side of a vertical plane extending along said axis when said element is at said position, and further comprising locating means for securing the element to the gun at said position, said locating means comprising means for engaging in a port of said flash hider means.

2. A stabilizer according to claim 1, wherein the locating means for securing the element is a stop for passing through the element and engaging in a flash hider port.

3. A stabilizer according to claim 2, wherein the stop is mounted on a lever which can move the stop to a condition in which it passes through the element and can also retract the stop from the port.

4. A stabilizer according to claim 3, wherein the locating means has a resilient clip for releasably engaging the barrel (or flash hider) and securing the lever in position with the stop projecting in the port.

5. A stabilizer according to claim 3, wherein the lever has an additional catch (is incorporated on the lever to locate into or behind the )engageable with a flash hider to prevent forward movement of the stabilizer.

* * * * *

UNITED STATES PATENT AND TRADEMARK OFFICE

CERTIFICATE OF CORRECTION

PATENT NO. : 4,235,152

DATED : November 25, 1980

INVENTOR(S) : Marthinus J. Bekker, Douglas J. M. Hall

It is certified that error appears in the above—identified patent and that said Letters Patent is hereby corrected as shown below:

Col. 3, line 11 "these" should be "those".

Col. 6, line 30 "(or flash hider)" should be deleted.

Col. 6, lines 33-34, "(is incorporated on the lever to locate into or behind the)" should be deleted.

Signed and Sealed this

*Twelfth* Day of *May 1981*

[SEAL]

*Attest:*

RENE D. TEGTMEYER

*Attesting Officer* *Acting Commissioner of Patents and Trademarks*